United States Patent [19]

Jackson

[11] Patent Number: 4,902,539

[45] Date of Patent: Feb. 20, 1990

[54] FUEL-OXIDANT MIXTURE FOR DETONATION GUN FLAME-PLATING

[75] Inventor: John E. Jackson, Brownsburg, Ind.

[73] Assignee: Union Carbide Corporation, Danbury, Conn.

[21] Appl. No.: 146,723

[22] Filed: Feb. 4, 1988

Related U.S. Application Data

[63] Continuation-in-part of Ser. No. 110,841, Oct. 21, 1987, abandoned.

[51] Int. Cl.[4] ..... B05D 1/10

[52] U.S. Cl. ..... 427/423; 149/109.2; 239/13; 252/372; 89/7

[58] Field of Search ..... 427/422, 423; 239/81, 239/13; 252/372; 149/109.2; 89/7

[56] References Cited

U.S. PATENT DOCUMENTS

| | | | |
|---|---|---|---|
| 2,714,563 | 8/1955 | Poorman et al. | 117/105 |
| 2,964,420 | 12/1960 | Poorman et al. | 427/423 X |
| 2,972,550 | 2/1961 | Pelton | 117/21 |
| 2,976,166 | 3/1961 | White et al. | 427/423 X |
| 2,992,595 | 7/1961 | Owen | 89/7 |
| 3,071,489 | 1/1963 | Pelton et al. | 117/22 |
| 3,150,828 | 9/1964 | Pelton et al. | 239/79 |
| 3,150,938 | 9/1964 | Pelton et al. | 29/194 |
| 3,505,101 | 4/1970 | Koffskey, Jr. et al. | 427/423 X |
| 3,773,259 | 11/1973 | Zverev | 239/81 |
| 3,801,346 | 4/1974 | Melton, Jr. et al. | 117/16 |
| 3,884,415 | 5/1975 | Zverev et al. | 239/79 |
| 3,910,494 | 10/1975 | Melton, Jr. | 239/13 |
| 4,004,735 | 1/1977 | Zverev et al. | 239/79 |
| 4,172,558 | 10/1979 | Zverev et al. | 239/85 |
| 4,215,819 | 8/1980 | Garda et al. | 239/81 |
| 4,231,518 | 11/1980 | Zverev et al. | 239/81 |
| 4,258,091 | 3/1981 | Dudko et al. | 427/422 |
| 4,279,383 | 7/1981 | Zverev et al. | 239/61 |
| 4,319,715 | 3/1982 | Garda et al. | 239/81 |
| 4,469,772 | 9/1984 | Barton et al. | 430/163 |
| 4,621,017 | 11/1986 | Chandler et al. | 427/430.1 X |
| 4,669,658 | 6/1987 | Nevgod et al. | 239/81 |
| 4,687,678 | 8/1987 | Lindblom | 427/423 X |
| 4,731,253 | 3/1988 | Dubois | 427/423 X |

OTHER PUBLICATIONS

Deposition of Coatings by Detonation Methods, A. I. Zverev et al. Leningrad, Soodestroyeniye Publishers, 1979 pp. 31–32 and pp. 165–166.

Coatings Based on Refractory Compounds Applied by Detonation V. I. Shesternenkov and E. A. Astakhov, Leningrad, Nauka Publishers, 1969, pp. 256–257.

*Primary Examiner*—Shrive P. Beck

*Assistant Examiner*—Alan Bashore

*Attorney, Agent, or Firm*—Cornelius F. O'Brien

[57] ABSTRACT

The invention relates to a fuel-oxidant mixture for detonation gun applications comprising an oxidant such as oxygen and a fuel mixture of two combustible gases such as acetylene and propylene. The invention also relates to articles coated in a process using this fuel-oxidant mixture.

29 Claims, 1 Drawing Sheet

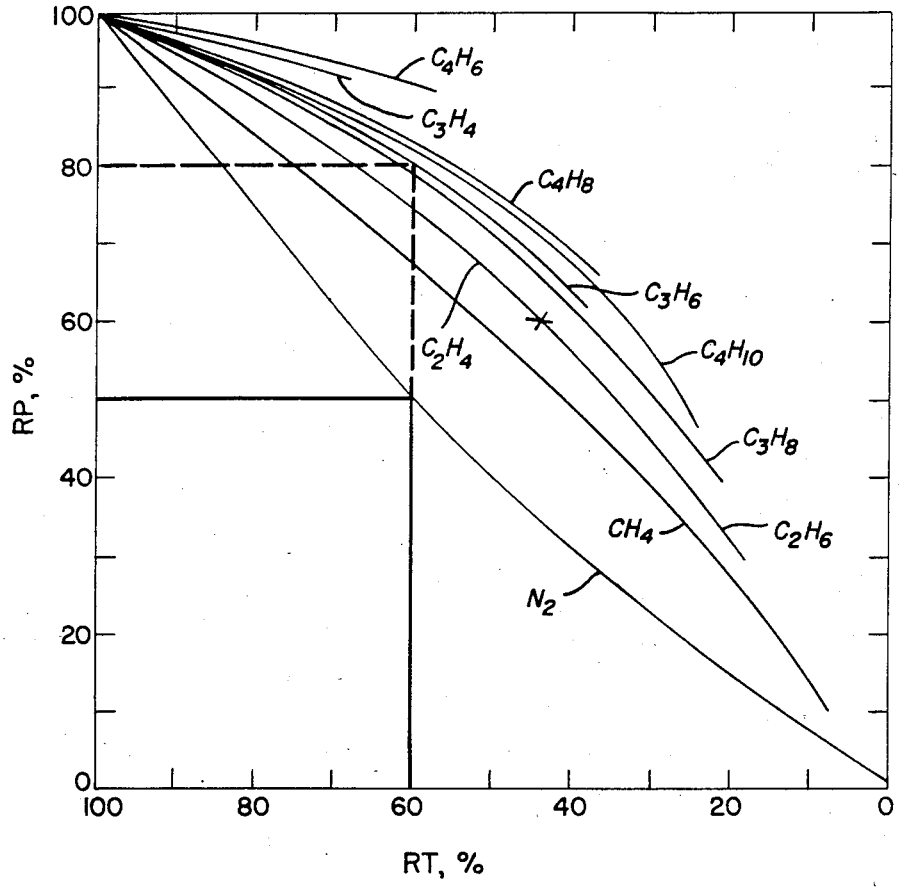
100
80
60
40
20
0
RP, %
100
80
60
40
20
0
RT, %
$C_4H_6$
$C_3H_4$
$C_4H_8$
$C_3H_6$
$C_4H_{10}$
$C_3H_8$
$C_2H_6$
$CH_4$
$N_2$
$C_2H_4$

FUEL-OXIDANT MIXTURE FOR DETONATION GUN FLAME-PLATING

This application is a Continuation-in-Part of application Ser. No. 110,841, filed Oct. 21, 1987 now abandoned.

FIELD OF THE INVENTION

The invention relates to a novel fuel-oxidant mixture for use with an apparatus for flame plating using detonation means and the coated layer produced therefrom. More particularly, the invention relates to a fuel oxidant mixture containing at least two combustible gases such as acetylene and propylene.

BACKGROUND OF THE INVENTION

Flame plating by means of detonation using a detonating gun (D-Gun) have been used in industry to produce coatings of various compositions for over a quarter of a century. Basically, the detonation gun consists of a fluid-cooled barrel having a small inner diameter of about one inch. Generally a mixture of oxygen and acetylene is fed into the gun along with a comminuted coating material. The oxygen-acetylene fuel gas mixture is ignited to produce a detonation wave which travels down the barrel of the gun where it heats the coating material and propels the coating material out of the gun onto an article to be coated. U.S. Pat. No. 2,714,563 discloses a method and apparatus which utilizes detonation waves for flame coating. The disclosure of this U.S. Pat. No. 2,714,563 is incorporated herein by reference as if the disclosure was recited in full text in this specification.

In general, when the fuel gas mixture detonation gun is ignited, detonation waves are produced that accelerate the comminuted coating material to about 2400 ft/sec while heating it to a temperature about its melting point. After the coating material exits the barrel of the detonation gun a pulse of nitrogen purges the barrel This cycle is generally repeated about four to eight times a second. Control of the detonation coating is obtained principally by varying the detonation mixture of oxygen to acetylene.

In some applications, such as producing tungsten carbide cobalt-based coatings, it was found that improved coatings could be obtained by diluting the oxygen-acetylene fuel mixture with an inert gas such as nitrogen or argon. The gaseous diluent has been found to reduce or tend to reduce the flame temperature since it does not participate in the detonation reaction. U.S. Pat. No. 2,972,550 discloses the process of diluting the oxygen acetylene fuel mixture to enable the detonation plating process to be used with an increased number of coating compositions and also for new and more widely useful applications based on the coating obtainable. The disclosure of this U.S. Pat. No. 2,972,550 is incorporated herein by reference as if the disclosure was recited in full text in this specification.

Generally, acetylene has been used as the combustible fuel gas because it produces both temperatures and pressures greater than those obtainable from any other saturated or unsaturated hydrocarbon gas. However, for some coating applications,, the temperature of combustion of an oxygen-acetylene mixture of about 1:1 atomic ratio of oxygen to carbon yields combustion products much hotter than desired. As stated above, the general procedure for compensating for the high temperature of combustion of the oxygen-acetylene fuel gas is to dilute the fuel gas mixture with an inert gas such as nitrogen or argon. Although this dilution resulted in lowering the combustible temperature, it also results in a concomitant decrease in the peak pressure of the combustion reaction. This decrease in peak pressure results in a decrease in the velocity of the coating material propelled from the barrel onto a substrate. It has been found that with an increase of a diluting inert gas to the oxygen-acetylene fuel mixture, the peak pressure of the combustion reaction decreases faster than does the combustion temperature.

SUMMARY OF THE INVENTION

It is an object of the present invention to provide a novel gaseous fuel oxidant mixture for use in a detonation gun that can provide for lower fuel combustion temperatures than that obtainable from conventional oxygen acetylene fuel gases while providing for relatively high peak pressures in the combustion reaction.

Another object of the present invention is to provide a novel gaseous fuel-oxidant mixture for use in a detonation gun that can provide for the same fuel combustion temperatures than that obtainable from conventional oxygen acetylene fuel gases diluted with an inert gas while not sacrificing peak pressure in the combustion reaction.

Another object of the present invention is to provide novel coatings for substrates using the novel gaseous fuel-oxidant mixture of this invention.

The invention relates to a gaseous fuel oxidant mixture for use in a detonation gun, comprising:

(a) an oxidant and (b) a fuel mixture of at least two combustible gases selected from the group of saturated and unsaturated hydrocarbons.

The invention also relates to an improvement in a process of flame plating with a detonation gun which comprises the step of introducing desired fuel and oxidant gases into the detonation gun to form a detonatable mixture, introducing a comminuted coating material into said detonatable mixture within the gun, and detonating the fuel-oxidant mixture to impinge the coating material onto an article to be coated and in which the improvement comprises using a detonatable fuel oxidant mixture of an oxidant and a fuel mixture of at least two combustible gases selected from the group of saturated and unsaturated hydrocarbons. The detonation gun could consist of a mixing chamber and a barrel portion so that the detonatable fuel-oxidant mixture could be introduced into the mixing and ignition chamber while a comminuted coating material is introduced into the barrel. The ignition of the fuel oxidant mixture would then produce detonation waves which travel down the barrel of the gun where it heats the comminuted coating material and propels the coating material onto a substrate.

The invention also relates to the coated product obtained using the novel process of this invention.

The oxidant for use in this invention could be selected from the group consisting of oxygen, nitrous oxide and mixtures thereof and the like.

The combustible fuel mixture of at least two gases for use in this invention can be selected from the group consisting of acetylene ($C_2H_2$), propylene ($C_3H_6$), methane ($CH_4$), ethylene ($C_2H_4$), methyl acetylene ($C_3H_4$), propane ($C_3H_8$), ethane $C_2H_6$), butadienes $C_4H_6$), butylenes $C_4H_8$), butanes ($C_4H_{10}$), cyclopropane ($C_3H_6$), propadiene ($C_3H_3$), cyclobutane ($C_4H_8$) and ethylene oxide ($C_2H_4O$). The preferred fuel mixture would comprise acetylene gas along with at least one other combustible gas such as propylene.

BRIEF DESCRIPTION OF THE DRAWINGS

The drawing FIGURE is a graphical representation of RP% versus RT% for an oxygen-actylene mixture diluted with nitrogen or an acetylene-second hydrocarbon mixture.

DESCRIPTION OF THE PREFERRED EMBODIMENTS

As stated above, acetylene is considered to be the best combustible fuel for detonation gun operations since it produces both temperatures and pressures greater than those obtainable from any other saturated or unsaturated hydrocarbon. To reduce the temperature of the reaction products of the combustible gas, nitrogen or argon was generally added to dilute the oxidant-fuel mixture. This had the disadvantage of lowering the pressure of the detonation wave thus limiting the achievable particle velocity. Unexpectedly, it was discovered that when a second combustible gas, such as propylene, is mixed with acetylene, the reaction of the combustible gases with an appropriate oxidant yields a peak pressure at any temperature that is higher than the pressure of an equivalent temperature nitrogen diluted acetylene-oxygen mixture. If, at a given temperature, an acetylene-oxygen-nitrogen mixture is replaced by an acetylene-second combustible gas-oxygen mixture, the gaseous mixture containing the second combustible gas will always yield higher peak pressure than the acetylene oxygen-nitrogen mixture.

The theoretical values of RP% and RT% are defined as follows:

$RP\% = 100\ (P_D/P_o)$ $RT\% = 100\ \Delta T_D/\Delta T_o$.

$P_o$ and $\Delta T_o$ are respectively the pressure and temperature rise following the detonation of a 1:1 mixture of oxygen and acetylene from the following equation:

$$C_2H_2 + O_2 \rightarrow 2\ CO + H_2.$$

$P_D$ and $\Delta T_D$ are, respectively, the pressure rise and temperature rise following the detonation of either an oxygen-acetylene mixture diluted with nitrogen or an acetylene-second hydrocarbon gas-oxygen mixture where the ratio of carbon to oxygen is 1:1.

Different temperatures are achieved by using different values for either X or Y in the following equations:

$$C_2H_2 + O_2 + XN_2 = 2CO + H_2 + XN_2 \quad (2a)$$

$$[1-Y]C_2H_2 + yC_4H_B + [1-y + Ay/2]O_2 \longrightarrow [2-2Y + AY]CO + [1-y + BY/2]H_2 \quad (2b)$$

The values of RP% versus RT% for the detonation of either an oxygen-acetylene mixture diluted with nitrogen or an acetylene second hydrocarbon-oxygen mixture are shown in the drawing figure. As evident from the drawing figure, as one adds $N_2$, as in Equation 2a, to lower the value of $\Delta T_D$ and hence RT%, the peak pressure $P_D$ and hence RP%, is also decreased. For example, if sufficient nitrogen is added to reduce $\Delta T_D$ to 60% of $\Delta T_o$, the peak pressure $P_D$ drops to 50% of $P_o$. If, however, an acetylene-second hydrocarbon oxygen mixture is used for any value of ΔTD or RT%, the value of $P_D$ and hence RP% will be larger than if a nitrogen diluted acetylene oxygen mixture is used. For example, as shown in FIG. 1, if an acetylene-propylene oxygen mixture is used to obtain a value of RT% equal to 60%, the ratio of RP% is 80%, a value 1.6 times greater than if an acetylene-oxygen-nitrogen mixture is employed to achieve a value of RT% equal to the same value. It is believed that higher pressures increase particle velocity, which results in improved coating properties.

For most applications the gaseous fuel-oxidant mixture of this invention could have an atomic ratio of oxygen to carbon of from about 0.9 to about 2.0, preferably from about 0.95 to about 1.6 and most preferably from about 0.98 to 1.4. An atomic ratio of oxygen to carbon below 0.9 would generally be unsuitable because of the formation of free carbon and soot while a ratio above 2.0 would generally be unsuitable for carbide and metallic coatings because the flame becomes excessively oxidizing.

In a preferred embodiment of the invention the gaseous fuel-oxidant mixture would comprise from 35 to 80 percent by volume oxygen, from 2 to 50 percent by volume acetylene and 2 to 60 percent by volume of a second combustible gaseous fuel. In a more preferable embodiment of the invention the gaseous fuel-oxidant mixture would comprise from 45 to 70 percent by volume oxygen, from 7 to 45 percent by volume acetylene and 10 to 45 percent by volume of a second combustible fuel. In another more preferable embodiment of the invention the gaseous fuel-oxidant mixture would comprise from 50 to 65 percent by volume oxygen, from 12 to 26 percent by volume acetylene and 18 to 30 percent by volume of a second combustible gaseous fuel such as propylene. In some applications, it may be desirable to add an inert diluant gas to the gaseous fuel oxidant mixture. Suitable inert diluting gases would be argon, neon, krypton, xenon, helium and nitrogen.

Generally, all prior art coating materials that could be employed with the fuel-oxidant mixture of the prior art in detonation gun applications can be used with the novel gaseous fuel-oxidant mixture of this invention. In addition, the prior art coating compositions, when applied at lower temperatures and higher pressures than that of the prior art, produce coatings on substrates that have conventional compositions but novel and unobvious physical characteristics such as hardness. Examples of suitable coating compositions for use with the gaseous fuel oxidant mixture of this invention would include tungsten carbide-cobalt, tungsten carbide nickel, tungsten carbide-cobalt chromium, tungsten carbide-nickel chromium, chromium-nickel, aluminum oxide, chromium carbide nickel chromium, chromium carbide-cobalt chromium, tungsten titanium carbide nickel, cobalt alloys, oxide dispersion in cobalt alloys, alumina-titania, copper based alloys, chromium based alloys, chromium oxide, chromium oxide plus aluminum oxide, titanium oxide, titanium plus aluminum oxide, iron based alloys, oxide dispersed in iron based-alloys, nickel, nickel based alloys, and the like. These unique coating materials are ideally suited for coating substrates made of materials such as titanium, steel, aluminum nickel, cobalt, alloys thereof and the like.

The powders for use in the D-Gun for applying a coating according to the present invention are preferably powders made by the cast and crushed process. In this process the constituents of the powder are melted and cast into a shell shaped ingot Subsequently, this ingot is crushed to obtain a powder which is then screened to obtain the desired particle size distribution.

However, other forms of powder, such as sintered powders made by a sintering process, and mixes of powders can also be used. In the sintering process, the constituents of the powder are sintered together into a sintered cake and then this cake is crushed to obtain a powder which is then screened to obtain the desired particle size distribution.

Some examples are provided below to illustrate the present invention. In these examples, coatings were made using the following powder compositions shown in Table 1.

TABLE 1

| Sample Powder | Coating Material Powders: Composition - wt % Co | C | Fe | Other | W | Powder Size: % thru Mesh* | Max. % of Min. size |
|---|---|---|---|---|---|---|---|
| A Cast & Crushed | 9.0 to 10.0 | 4.3 to 4.8 | 1.5 max | .21 max | Bal. | 95% thru 325 | 10% less than 5 microns |
| B Sintered | 11 to 13 | 5.15 min. | 0.5 max | 0.5 max | Bal. | 98% thru 325 | 15% less than 15 microns |
| C Mix of Cast & Crushed & Sintered | 10.5 to 12.5 | 4.5 to 4.8 | 1.25 max | 1.0 max | Bal. | 98% thru 325 | 15% less than 5 microns |
| D Cast & Crushed | 10 to 12 | 3.9% to 4.3 | 2.0 max | 0.2 max | Bal. | 98% thru 325 | 10% less than 5 microns |

*U.S. Standard Mesh size.

EXAMPLE 1

The gaseous fuel-oxidant mixtures of the compositions shown in Table 2 were each introduced to a detonation gun to form a detonatable mixture having an oxygen to carbon atomic ratio as shown in Table 2. Sample coating powder A was also fed into the detonation gun. The flow rate of each gaseous fuel-oxidant mixture was 13.5 cubic feet per minute (cfm) except for samples 28, 29 and 30 which were 11.0 cfm, and the feed rate of each coating powder was 53.3 grams per minute (gpm) except for sample 29 which was 46.7 gpm and sample 30 which was 40.0 gpm. The gaseous fuel mixture in volume percent and the atomic ratio of oxygen to carbon for each coating example are shown in Table 2. The coating sample powder was fed into the detonation gun at the same time as the gaseous fuel-oxidant mixture. The detonation gun was fired at a rate of about 8 times per second and the coating powder in the detonation gun was impinged onto a steel substrate to form a dense, adherent coating of shaped microscopic leaves interlocking and overlapping with each other.

The percent by weight of the cobalt and carbon in the coated layer were determined along with the hardness for the coating. The hardness of most of the coating examples in Table 2 were measured as the Rockwell superficial hardness and converted into Vickers hardness. The Rockwell superficial hardness method employed is per ASTM standard method E 18. The hardness is measured on a smooth and flat surface of the coating itself deposited on a hardened steel substrate. The Rockwell hardness numbers were converted into Vickers hardness numbers by the following formula: $HV.3 = -1774 + 37.433\ HR45N$ where HV.3 is the Vickers hardness obtained with 0.3 kgf load and HR45N is the Rockwell superficial hardness obtained on the N scale with a diamond penetrator and a 45 kgf load. The hardness of the coatings of line 28, 29 and 30 was measured directly as Vickers hardness. The Vickers hardness method employed is measured essentially per ASTM standard method E 384, with the exception that only one diagonal of the square indentation was measured rather than measuring and averaging the lengths of both diagonals. A load of 0.3 kgf was used (HV.3). These data are shown in Table 2. The values shows that the hardness was superior for coatings obtained using propylene in place of nitrogen in the gaseous fuel mixture.

Erosion is a form of wear by which material is removed from a surface by the action of impinging particles. The particles are generally solid and carried in either a gaseous or a fluid stream, although the particles may also be fluid carried in a gaseous stream.

There are a number of factors which influence the wear by erosion. Particle size and mass, and their velocity are obviously important because they determine the kinetic energy of the impinging particles. The type of particles, their hardness, angularity and shape, and their concentration may also affect the rate of erosion. Furthermore, the angle of particle impingement will also affect the rate of erosion. For test purposes, alumina and silica powders are widely used.

The test procedure similar to the method described in ASTMG 76-83 was used to measure the erosion wear rate of the coatings presented in the examples. Essentially, about 1.2 gm per minute of alumina abrasive is carried in a gas stream to a nozzle which is mounted on a pivot so that it can be set for various particle impingement angles while a constant standoff is maintained. It is standard practice to test the coatings at both 90° and 30° impingement angles.

During the test, the impinging particles create a crater on the test sample The measured scar depth of the crater is divided by the amount of abrasive which impinged on the sample. The results, in micrometers (microns) of wear per gram of abrasive, is taken as the erosion wear rate ($\mu$/gm). These data are also shown in Table 2.

The hardness and erosion wear data show that using an acetylene hydrocarbon gas oxygen mixture in place of a nitrogen diluted acetylene-oxygen mixture can produce a coating having a higher hardness at the same cobalt content (compare sample coating 9 with sample coatings 22 and 23) or higher cobalt content at the same hardness (compare sample coating 1 with sample coating 22).

TABLE 2

D-GUN PARAMETERS AND PROPERTIES OF COATINGS MADE FROM POWDER A

| Sample Coating | Gaseous Fuel-Mixture (Vol %) | | | $O_2$ to C Atomic Ratio | Hardness(1) Vickers ($kg/mm^2$) | Chemistry % Co | Chemistry % C | Erosion ($\mu$/gm) 90° | Erosion ($\mu$/gm) 30° |
|---|---|---|---|---|---|---|---|---|---|
| | $C_3H_6$ | $C_2H_2$ | $O_2$ | | | | | | |
| 1 | 37.0 | 3.7 | 59.3 | 1.0 | 1130 | 19.1 | 3.5 | 116 | 22 |
| 2 | 29.8 | 12.8 | 57.4 | 1.0 | 1185 | 17.0 | 3.1 | 103 | 20 |
| 3 | 29.8 | 10.0 | 60.2 | 1.1 | 1185 | 15.6 | 2.3 | 85 | 20 |
| 4 | 29.8 | 7.5 | 62.7 | 1.2 | 1160 | 14.3 | 1.8 | 94 | 21 |
| 5 | 29.8 | 5.3 | 64.9 | 1.3 | 1145 | 13.3 | 1.6 | 92 | 22 |
| 6 | 29.8 | 3.2 | 67.0 | 1.4 | 1135 | 12.8 | 1.3 | 90 | 22 |
| 7 | 25.6 | 18.0 | 56.4 | 1.0 | 1225 | 16.7 | 3.5 | 94 | 19 |
| 8 | 25.6 | 16.6 | 57.8 | 1.05 | 1210 | 14.1 | 2.8 | 90 | 20 |
| 9 | 25.6 | 15.3 | 59.1 | 1.1 | 1225 | 13.6 | 2.1 | 82 | 19 |
| 10 | 25.6 | 12.9 | 61.5 | 1.2 | 1190 | 12.8 | 1.6 | 78 | 21 |
| 11 | 25.6 | 10.6 | 63.8 | 1.3 | 1185 | 11.4 | 1.4 | 75 | 20 |
| 12 | 25.6 | 8.6 | 65.8 | 1.4 | 1160 | 11.0 | 1.2 | 79 | 23 |
| 13 | 25.6 | 6.7 | 67.7 | 1.5 | 1145 | 10.6 | 1.0 | 81 | 24 |
| 14 | 25.6 | 5.7 | 68.7 | 1.6 | 1120 | 10.7 | 1.0 | 84 | 25 |
| 15 | 25.6 | 3.4 | 71.0 | 1.7 | 1110 | 10.3 | 0.9 | 94 | 26 |
| 16 | 18.6 | 26.7 | 54.7 | 1.0 | 1220 | 14.2 | 3.6 | 104 | 23 |
| 17 | 18.6 | 24.1 | 57.3 | 1.1 | 1240 | 11.3 | 2.2 | 87 | 24 |
| 18 | 18.6 | 21.8 | 59.6 | 1.2 | 1180 | 10.1 | 1.6 | 81 | 21 |
| 19 | 18.6 | 17.6 | 63.8 | 1.4 | 1195 | 8.0 | 0.9 | 74 | 20 |
| 20 | 18.6 | 14.1 | 67.3 | 1.6 | 1110 | 7.8 | 0.6 | 95 | 26 |
| 21 | 18.6 | 11.1 | 70.3 | 1.8 | 1095 | 7.9 | 0.6 | 122 | 28 |
| | $N_2$ | | | | | | | | |
| 22 | 45 | 27.8 | 27.2 | 0.98 | 1140 | 13.6 | 3.6 | 94 | 20 |
| 23 | 45 | 27.5 | 27.5 | 1.0 | 1030 | 13.6 | 3.5 | 90 | 18 |
| 24 | 45 | 25.0 | 30.0 | 1.2 | 1009 | 11.4 | 2.1 | 77 | 16 |
| 25 | 45 | 22.9 | 32.1 | 1.4 | 991 | 11.2 | 1.6 | 81 | 22 |
| 26 | 45 | 21.2 | 33.8 | 1.6 | 883 | 10.9 | 1.2 | 94 | 23 |
| 27 | 45 | 19.6 | 35.4 | 1.8 | 930 | 10.6 | 1.1 | 110 | 25 |
| 28 | 40 | 30.3 | 29.7 | 0.98 | 1080* | 13.2 | 3.5 | 106 | 20 |
| 29 | 30 | 35.3 | 34.7 | 0.98 | 1150* | 10.7 | 3.6 | 109 | 18 |
| 30 | 10 | 42.8 | 42.2 | 0.98 | 1300* | 6.8 | 3.7 | 119 | 20 |

Note (1) measured as Rockwell superficial hardness and converted to Vickers hardness unless otherwise indicated by an asterisk (*).

EXAMPLE 2

The gaseous fuel-oxidant mixture of the compositions shown in Table 3 were each introduced into a detonation gun at a flow rate of 13.5 cubic feet per minute to form a detonatable mixture having an atomic ratio of oxygen to carbon as also shown in Table 3. The coating powder was Sample A and the fuel-oxidant mixture and powder feed rate are as also shown in Table 3. As in Example 1, the Vickers hardness and erosion rate ($\mu$/gm) data were determined and these data are shown in Table 3. As evidenced from the data, various hydrocarbon gases can be used in conjunction with acetylene to provide a gaseous fuel-oxidant mixture in accordance with this invention to coat substrates. The Vickers hardness data show that using an acetylene-hydrocarbon gas oxygen mixture in place of an acetylene-oxygen-nitrogen mixture can produce either a coating having a higher hardness at the same cobalt content (compare sample coatings 5 and 10 with sample coating 23 in Table 2) or a coating having a higher cobalt content for the same hardness (compare sample coatings 6, 8 and 11 with sample coating 22 in Table 2).

TABLE 3

D-GUN PARAMETERS AND PROPERTIES OF COATINGS MADE FROM POWDER A

| Sample Coating | Gaseous Fuel-Mixture (Vol %) | | | $O_2$ to C Atomic Ratio | Powder Feed Rate (gmp) | Hardness Vickers ($kg/mm^2$) | Chemistry % Co | Chemistry % C | Erosion ($\mu$/gm) 90° | Erosion ($\mu$/gm) 30° |
|---|---|---|---|---|---|---|---|---|---|---|
| | $CH_4$ | $C_2H_2$ | $O_2$ | | | | | | | |
| 1 | 12.9 | 40.3 | 46.8 | 1.0 | 53 | 1272 | 9.3 | 3.6 | 93 | 20 |
| 2 | 21.2 | 34.1 | 44.7 | 1.0 | 53 | 1231 | 12.6 | 3.4 | 96 | 21 |
| 3 | 27.8 | 29.2 | 43.0 | 1.0 | 53 | 1180 | 15.1 | 3.2 | 102 | 21 |
| | $C_2H_4$ | | | | | | | | | |
| 4 | 17.1 | 32.9 | 50.0 | 1.0 | 53 | 1270 | 9.6 | 3.7 | 96 | 20 |
| 5 | 29.2 | 20.8 | 50.0 | 1.0 | 53 | 1186 | 13.6 | 3.7 | 97 | 21 |
| 6 | 39.2 | 10.8 | 50.0 | 1.0 | 53 | 1160 | 16.5 | 3.8 | 103 | 20 |
| 7 | 39.2 | 10.8 | 50.0 | 1.0 | 40 | 1192 | 17.3 | 3.6 | 103 | 20 |
| | $C_3H_6$ | | | | | | | | | |
| *8 | 17.1 | 19.6 | 45.0 | 1.0 | 53 | 1120 | 16.2 | 3.5 | 97 | 21 |
| | $C_3H_8$ | | | | | | | | | |
| 9 | 7.0 | 41.2 | 51.8 | 1 | 53 | 1240 | 9.5 | 3.8 | 112 | 21 |
| 10 | 12.3 | 34.6 | 53.1 | 1 | 53 | 1196 | 13.3 | 3.8 | 99 | 21 |
| 11 | 16.8 | 29.0 | 54.2 | 1 | 53 | 1140 | 16.6 | 3.7 | 106 | 20 |

TABLE 3-continued

| Sample Coating | Gaseous Fuel-Mixture (Vol %) | $C_2H_2$ | $O_2$ | $O_2$ to C Atomic Ratio | Powder Feed Rate (gmp) | Hardness Vickers (kg/mm²) | Chemistry % Co | Chemistry % C | Erosion (μ/gm) 90° | Erosion (μ/gm) 30° |
|---|---|---|---|---|---|---|---|---|---|---|
| | D-GUN PARAMETERS AND PROPERTIES OF COATINGS MADE FROM POWDER A | | | | | | | | | |
| 12 | 16.8 | 29.0 | 54.2 | 1 | 40 | 1161 | 16.9 | 3.6 | 102 | 19 |
| | $C_4H_{10}$ | | | | | | | | | |
| 13 | 5.7 | 41.5 | 52.9 | 1 | 53 | 1263 | 9.5 | 3.8 | 106 | 19 |

*Sample Coating 8 also contained 18.3 volume percent nitrogen.

EXAMPLE 3

The gaseous fuel-oxidant mixture of the compositions shown in Table 4 were each introduced into a detonation gun to form a detonatable mixture having an atomic ratio of oxygen to carbon as also shown in Table 4. The coating powder was sample B and the fuel-oxidant mixture is as also shown in Table 4. The gas flow rate was 13.5 cubic feet per minute (cfm) with the feed rate being as shown in Table 4. As in Example 1, the hardness and erosion rate (μ/gm) were determined and these data are shown in Table 4. While sintered powders do not show a great change in cobalt content with gun temperature changes, higher hardness coatings with equivalent cobalt contents can be obtained with acetylene-hydrocarbon gas-oxygen mixtures than with acetylene-oxygen nitrogen mixtures (compare sample coating 4 with sample coating 1).

TABLE 4

| Sample Coating | Gaseous Fuel-Mixture (Vol %) | $C_2H_2$ | $O_2$ | $O_2$ to C Atomic Ratio | Powder Feed Rate (gpm) | Hardness Vickers (Kg/mm²) | Chemistry % Co | Chemistry % C | Erosion (μ/gm) 90° | Erosion (μ/gm) 30° |
|---|---|---|---|---|---|---|---|---|---|---|
| | D-GUN PARAMETERS AND PROPERTIES OF COATINGS MADE FROM POWDER B | | | | | | | | | |
| | $N_2$ | | | | | | | | | |
| 1 | 45 | 27.8 | 27.2 | 0.98 | 17 | 940 | 12.9 | 5.2 | | |
| 2 | 45 | 27.8 | 27.2 | 0.98 | 25 | 920 | 13.1 | 5.1 | 76 | 9.5 |
| | $C_3H_6$ | | | | | | | | | |
| 3 | 18.6 | 27.3 | 54.1 | 0.98 | 17 | 1070 | 13.3 | 5.1 | 82 | 12 |
| 4 | 18.6 | 27.3 | 54.1 | 0.98 | 25 | 1160 | 12.9 | 5.2 | 72 | 11 |
| 5 | 25.6 | 18.6 | 55.8 | 0.98 | 25 | 1045 | 13.5 | 5.2 | 68 | 9 |
| 6 | 29.8 | 12.8 | 57.4 | 1.0 | 25 | 890 | 12.7 | 4.5 | 71 | 8 |
| 7 | 37 | 3.7 | 59.3 | 1.0 | 25 | 935 | 13.6 | 5.2 | 86 | 9 |

EXAMPLE 4

The gaseous fuel oxidant mixture of the compositions shown in Table 5 were each introduced into a detonation gun to form a detonatable mixture having an atomic ratio of oxygen to carbon as also shown in Table 5. The coating powder was sample C and the fuel oxidant mixture is as also shown in Table 5. The gas flow rate was 13.5 cubic feet per minute (cfm) with the feed rate being as shown in Table 5. As in Example 1, the Vickers hardness and erosion rate (μ/gm) were determined and these data are shown in Table 5. The Vickers hardness data show that using an acetylene-hydrocarbon gas-oxygen mixture in place of an acetylene-oxygen-nitrogen mixture can produce a coating having a higher hardness at the same cobalt content (compare sample coating 2 with sample coating 1).

TABLE 5

| Sample Coating | Gaseous Fuel-Mixture (Vol %) | $C_2H_2$ | $O_2$ | $O_2$ to C Atomic Ratio | Powder Feed Rate (gpm) | Hardness Vickers (Kg/mm²) | Chemistry % Co | Chemistry % C | Erosion (μ/gm) 90° | Erosion (μ/gm) 30° |
|---|---|---|---|---|---|---|---|---|---|---|
| | D-GUN PARAMETERS AND PROPERTIES OF COATINGS MADE FROM POWDER C | | | | | | | | | |
| | $N_2$ | | | | | | | | | |
| 1 | 45 | 27.5 | 27.5 | 1.0 | 36.7 | 980 | 13.4 | 4.1 | 79 | 15 |
| | $C_3H_6$ | | | | | | | | | |
| 2 | 18.6 | 26.8 | 54.7 | 1.0 | 36.7 | 1168 | 13.2 | 4.1 | 87 | 15 |
| 3 | 29.8 | 12.8 | 57.5 | 1.0 | 36.7 | 1149 | 15.0 | 4.0 | 76 | 13 |
| 4 | 29.8 | 12.8 | 57.5 | 1.0 | 53.3 | 1194 | 14.7 | 4.0 | 74 | 12 |
| 5 | 29.8 | 10.0 | 60.2 | 1.1 | 36.7 | 1129 | 14.0 | 2.9 | 74 | 14 |

EXAMPLE 5

The gaseous fuel-oxidant mixture of the compositions shown in Table 6 were each introduced into a detonation gun to form a detonatable mixture having an atomic ratio of oxygen to carbon as also shown in Table 6. The coating powder was sample D and the fuel-oxidant mixture is as also shown in Table 6. The gas flow rate was 13.5 cubic feet per minute (cfm) except for sample coatings 17, 18 and 9 which were 11.0 cfm, and the feed rate was 46.7 grams per minute (gpm). As in Example 1, the Vickers hardness and erosion rate (μ/gm) were determined and these data are shown in Table 6. The Vickers hardness data show that using an acetylene-hydrocarbon gas-oxygen mixture in place of an acetylene-oxygen nitrogen mixture can produce either a coating having a higher hardness at the same cobalt content (compare sample coating 5 with sample coating 17) or a coating having a higher cobalt content for the same hardness (compare sample coating 5 with sample coating 18).

TABLE 6

D-GUN PARAMETERS AND PROPERTIES OF COATINGS MADE FROM POWDER D

| Sample Coating | Gaseous Fuel-Mixture (Vol %) $C_3H_6$ | $C_2H_2$ | $O_2$ | $N_2$ | $O_2$ to C Atomic Ratio | Hardness(1) Vickers ($Kg/mm^2$) | Chemistry % Co | % C | Erosion ($\mu$/gm) 90° | 30° |
|---|---|---|---|---|---|---|---|---|---|---|
| 1 | 37.0 | 3.7 | 59.3 | — | 1.0 | | 17.6 | 3.2 | | |
| 2 | 29.8 | 12.8 | 57.4 | — | 1.0 | 1235 | 15.2 | 2.4 | 109 | 24 |
| 3 | 29.8 | 7.5 | 62.7 | — | 1.2 | 1200 | 13.2 | 0.9 | 86 | 25 |
| 4 | 29.8 | 3.2 | 67.0 | — | 1.4 | 1180 | 11.6 | 0.6 | 77 | 24 |
| 5 | 25.6 | 18.0 | 56.4 | — | 1.0 | 1250 | 15.5 | 3.2 | 100 | 25 |
| 6 | 25.6 | 16.6 | 57.8 | — | 1.05 | 1230 | 14.3 | 2.1 | 88 | 24 |
| 7 | 25.6 | 15.3 | 59.1 | — | 1.1 | 1185 | 13.7 | 1.6 | 81 | 24 |
| 8 | 25.6 | 12.9 | 61.5 | — | 1.2 | 1110 | 12.6 | 1.0 | 75 | 24 |
| 9 | 25.6 | 10.6 | 63.8 | — | 1.3 | 1215 | 14.4 | 1.3 | 81 | 24 |
| 10 | 25.6 | 8.6 | 65.8 | — | 1.4 | 1020 | 10.5 | 0.7 | 7.1 | 23 |
| 11 | 25.6 | 6.7 | 67.7 | — | 1.5 | 1095 | 9.9 | 0.5 | 75 | 25 |
| 12 | 25.6 | 5.7 | 68.7 | — | 1.6 | 1180 | 9.8 | 0.5 | 84 | 25 |
| 13 | 25.6 | 3.4 | 71.0 | — | 1.7 | 1115 | 9.5 | 0.5 | 93 | 25 |
| 14 | 18.6 | 24.1 | 57.3 | — | 1.1 | 1260 | 10.0 | 1.3 | 69 | 22 |
| 15 | 18.6 | 21.8 | 59.6 | — | 1.2 | 1215 | 9.3 | 0.9 | 65 | 22 |
| 16 | 18.6 | 17.6 | 63.8 | — | 1.4 | 920 | 7.0 | 0.5 | 101 | 25 |
| 17 | — | 30.3 | 29.7 | 40 | 0.98 | 1100* | 15.6 | 3.4 | 120 | 30 |
| 18 | — | 35.3 | 34.7 | 30 | 0.98 | 1250* | 12.2 | 3.5 | 120 | 26 |
| 19 | — | 42.8 | 42.2 | 10 | 0.98 | 1375* | 6.9 | 3.6 | 120 | 23 |

Note (1) Measured as Rockwell superficial hardness and converted to Vickers hardness unless otherwise indicated with an asterisk (*).

As many possible embodiments may be made of this invention without departing from the scope thereof, it being understood that all matter set forth is to be interpreted as illustrative and no in a limiting sense.

What is claimed is:

1. In a process of flame plating with a detonation gun, the improvement wherein a gaseous fuel-oxidant mixture is used which comprises: (a) an oxidant and (b) a fuel mixture of at least two combustible gases selected from the group of saturated and unsaturated hydrocarbons and wherein the combustion temperature of the fuel mixture is lower than the combustion temperature of one of the combustible gases.

2. The process of claim 1 wherein said fuel mixture comprises a mixture of acetylene and a second combustible gas selected from the group consisting of propylene, methane, ethylene, methyl acetylene, propane, pentane, a butadiene, a butalene, a butane,

3. The process of claim 2 wherein said oxidant is selected from the group consisting of oxygen, nitrous oxide and mixtures thereof.

4. The process of claim 3 wherein said mixture has an atomic ratio of oxygen to carbon of from about 0.9 to about 2.0.

5. The process of claim 4 wherein said second combustible gas is selected from the group consisting of propylene, propane and a butylene and the atomic ratio of oxygen to carbon is from about 0.95 to about 1.6.

6. The process of claim 5 wherein the second combustible gas consists essentially of propylene.

7. The process of claim 1 wherein the mixture contains from about 35 to 80 percent by volume of the oxidant, from about 2 to 50 percent by volume of acetylene, and from about 2 to 60 percent by volume of the second combustible gas.

8. The process of claim 7 wherein the mixture contains from about 45 to about 75 percent by volume oxygen, from about 2 to about 45 percent by volume acetylene and from about 5 to about 45 percent by volume of the second combustible gas.

9. The process of claim 8 wherein the mixture contains from about 50 to about 70 percent by volume oxygen, from about 3 to about 40 percent by volume acetylene and from about 8 to about 38 percent by volume of the second combustible gas.

10. The process of claim 9 wherein said second combustible gas consists essentially of propylene.

11. The process of claim 1, 2, 3 or 4 wherein said mixture contains a diluting gas.

12. The process of claim 11 wherein the diluting gas is selected from the group consisting of argon, neon, krypton, hydrogen, ammonia, xenon, helium and nitrogen.

13. The process of claim 12 wherein the diluting gas is nitrogen.

14. In the process of flame plating with a detonation gun which comprises the step of introducing desired fuel and oxidant gases into the gun to form a detonatable mixture, introducing a powdered coating material into said detonatable mixture within the gun, and detonating the fuel-oxidant mixture to impinge the coating material onto an article to be coated, the improvement which comprises using a detonatable fuel-oxidant mixture of (a) an oxidant and (b) a fuel mixture of at least two combustible gases selected from the group of saturated and unsaturated hydrocarbons and wherein the combustion temperature of the fuel mixture is lower than the combustion temperature of one of the combustible gases.

15. The process of claim 14 wherein said oxidant is selected from the group consisting of oxygen, nitrous oxide and mixtures thereof and wherein said fuel mixture comprises a mixture of acetylene and a second combustible gas selected from the group consisting of propylene, methane, ethylene, methyl acetylene, propane, pentane, a butadiene, a butylene, a butane, ethylene oxide, ethane, cyclopropane, propadiene, cyclobutane and mixtures thereof.

16. The process of claim 15 wherein said mixture contains an inert diluting gas.

17. The process of claim 14 wherein said mixture has an atomic ratio of oxygen to carbon of from about 0.9 to about 2.0.

18. The process of claim 17 wherein said second combustible gas is selected from the group consisting of propylene, propane and butylene and the atomic ratio of oxygen to carbon is from about 0.95 to about 1.6.

19. The process of claim 18 wherein the second combustible gas consists essentially of propylene.

20. The process of claim 15 wherein the mixture contains from about 45 to about 70 percent by volume of the oxidant, from about 7 to about 45 percent by volume of acetylene, and from about 10 to about 45 percent by volume of the second combustible gas.

21. The process of claim 19 wherein the mixture contains from about 50 to about 65 percent by volume oxygen, from about 12 to about 26 percent by volume acetylene and from about 18 to about 30 percent by volume of propylene.

22. In the process for operating a detonation gun having a mixing and ignition chamber and a barrel portion which comprises introducing desired fuel and oxidant gases into said gun through said mixing and ignition chamber, introducing a comminuted coating material into said barrel portion, and detonating the mixture within said gun to impinge the coating material onto an article to be coated, the improvement which comprises using a detonatable fuel-oxidant mixture of (a) an oxidant and (b) a fuel mixture of at least two combustible gases selected from the group of saturated and unsaturated hydrocarbon gases and wherein the combustion temperature of the fuel mixture is lower than the combustion temperature of one of the combustible gases.

23. The process of claim 21 wherein said oxidant is selected from the group consisting of oxygen, nitrous oxide and mixtures thereof, and wherein said fuel mixture comprises a mixture of acetylene and a second combustible gas selected from the group consisting of propylene, methane, ethylene, methyl acetylene, propane, pentane, a butadiene, a butylene, a butane, ethylene oxide, ethane, cyclopropane, propadiene, cyclobutane and mixtures thereof.

24. The process of claim 23 wherein said mixture contains an inert diluting gas.

25. The process of claim 23 wherein said mixture has an atomic ratio of oxygen to carbon from about 0.9 to about 2.0.

26. The process of claim 25 wherein said second combustible gas is selected from the group consisting of propane, propylene and butylene and the atomic ratio of oxygen to carbon is from about 0.95 to about 1.6.

27. The process of claim 26 wherein the second combustible gas consists essentially of propylene.

28. The process of claim 27 wherein the mixture contains from about 45 to about 70 percent by volume of the oxidant, from about 7 to about 45 percent by volume of acetylene, and from about 10 to about 45 percent by volume of the second combustible gas.

29. The process of claim 27 wherein the mixture contains from about 50 to about 65 percent by volume oxygen, from about 12 to about 26 percent by volume acetylene and from about 18 to about 30 percent by volume of propylene.

* * * * *

UNITED STATES PATENT AND TRADEMARK OFFICE

CERTIFICATE OF CORRECTION

PATENT NO. : 4.902,539

DATED : February 20, 1990

INVENTOR(S) : J. E. Jackson

It is certified that error appears in the above-identified patent and that said Letters Patent is hereby corrected as shown below:

Column 1, line 35 insert "in a" after the word ---mixture---

Column 1, line 40 insert a "." after the word ---barrel---

Column 1, line 64 delete second "," after ---application---

Column 2, line 67 insert "(" before --$C_2H_6$)--

Column 2, line 68 insert "(" before --$C_4H_6$)-- and insert "(" before --$C_4H_8$)--.

Column 3, line 1 "($C_3H_3$)" should read ---($C_3H_4$)---

Column 4, line 2 "ΔTD" should read ---$\Delta T_D$---

Column 5, line 2 insert a "." after the word ---ingot---

Column 8, Table 3 "(gmp)" should read ---(gpm)---

Column 9, Table 3-continued "(gmp)" should read ---(gpm)---

Column 9, Table 3-continued add "$C_3H_8$" to the column heading description of Sample Coating 12

Column 10, line 42 "9" should read ---19---

Column 11, Table 6 the last column, Erosion 90°, sample coating no. 10 change "7.1" to read ---71---

UNITED STATES PATENT AND TRADEMARK OFFICE

CERTIFICATE OF CORRECTION

PATENT NO. : 4.902,539

DATED : February 20, 1990

INVENTOR(S) : J. E. Jackson

It is certified that error appears in the above-identified patent and that said Letters Patent is hereby corrected as shown below:

Column 11, line 20 "no" should read ---not---

Column 11, claim 2, last line is incomplete. It should read --ethylene oxide, ethane, cyclopropane, propadiene, cyclobutane and mixtures thereof.

Signed and Sealed this

Second Day of April, 1991

*Attest:*

HARRY F. MANBECK, JR.

*Attesting Officer*

*Commissioner of Patents and Trademarks*